US006386285B1

(12) United States Patent
Heijnen et al.

(10) Patent No.: US 6,386,285 B1
(45) Date of Patent: May 14, 2002

(54) FLOW IDENTIFICATION SYSTEM

(75) Inventors: Wilhelmus Hubertus Paulus Maria Heijnen, Nienhagen (DE); Jan Fokke Holtrop, AS Den Haag (NL)

(73) Assignee: Shell Oil Company, Houston, TX (US)

( * ) Notice: Subject to any disclaimer, the term of this patent is extended or adjusted under 35 U.S.C. 154(b) by 15 days.

(21) Appl. No.: 09/724,071

(22) Filed: Nov. 28, 2000

(30) Foreign Application Priority Data

Nov. 29, 1999 (EP) ..... 99204022

(51) Int. Cl.[7] ..... E21B 47/10

(52) U.S. Cl. ..... 166/250.17; 166/50; 166/66; 166/177.2; 166/373

(58) Field of Search ..... 166/250.01, 250.17, 166/249, 313, 336, 369, 373, 50, 66, 177.1, 177.2

(56) References Cited

U.S. PATENT DOCUMENTS

| | | | |
|---|---|---|---|
| 2,794,182 A | | 5/1957 | Buck |
| 3,698,477 A | | 10/1972 | Radig et al. |
| 3,749,166 A | | 7/1973 | Young |
| 4,116,274 A | | 9/1978 | Rankin et al. |
| 4,139,059 A | | 2/1979 | Carmichael |
| 4,727,939 A | | 3/1988 | Airey |
| 5,083,452 A | | 1/1992 | Hope |
| 5,462,116 A | * | 10/1995 | Carroll |

FOREIGN PATENT DOCUMENTS

| | | |
|---|---|---|
| EP | 0872626 A2 | 10/1998 |

* cited by examiner

*Primary Examiner*—Roger Schoeppel

(57) ABSTRACT

A system for determining a characteristic of a stream of gas flowing through a branch wellbore of a multilateral wellbore system including a main wellbore extending from surface into the earth formation and a plurality of branch wellbores, each branch wellbore being provided with a conduit for passage of a stream of hydrocarbon gas from the earth formation to the main wellbore, the system comprising a plurality of sound generating devices, each sound generating device being arranged in a corresponding one of said conduits and being operable to produce a sound wave of selected frequency upon flow of the stream of gas along the sound generating device, the frequencies of the sound waves produced by the different sound generating devices being mutually different, the system further comprising a sound receiver capable of receiving each sound wave of selected frequency.

8 Claims, 2 Drawing Sheets

FLOW IDENTIFICATION SYSTEM

FIELD OF THE INVENTION

The present invention relates to a wellbore system including a main wellbore extending from surface into the earth formation and a plurality of branch wellbores. Such wellbore system is generally referred to as a multilateral, or branched, wellbore system.

In applications where hydrocarbon gas can be simultaneously produced via the branch wellbores so as to form a commingled stream of gas in the main wellbore, it is desirable to provide a system enabling the identification of those branch wellbores which are producing hydrocarbon gas.

Furthermore, in case one or more of the branch wellbores is producing at an undesirably high flow rate, it is desired to provide a system and a method which allows identification of said one or more of the branch wellbores.

Accordingly it is an object of the invention to provide a system and a method for determining which branch wellbore of a multilateral wellbore system is producing hydrocarbon gas.

SUMMARY OF THE INVENTION

In accordance with the invention there is provided a system for identifying a producing branch wellbore of a multilateral wellbore system including a main wellbore extending from surface into the earth formation and a plurality of branch wellbores, each branch wellbore being provided with a conduit for passage of a stream of hydrocarbon gas from the earth formation to the main wellbore, the system comprising a plurality of sound generating devices, each sound generating device being arranged in a corresponding one of said conduits and being operable to produce a sound wave of selected frequency upon flow of the stream of gas along the sound generating device, the frequencies of the sound waves produced by the different sound generating devices being mutually different, the system further comprising a sound receiver capable of receiving each sound wave of selected frequency.

By operating the sound receiver a record can be made of the sound waves produced by the different sound generating devices. Since the frequencies of the sound waves can be linked to the respective branch wellbores, it can thus be determined which branch wellbore is producing hydrocarbon gas.

Preferably the sound generating device is operable to produce a sound wave of amplitude depending on the flow rate of the stream of hydrocarbon gas.

More preferably the amplitude of the sound wave increases with increasing flow rate of the stream of hydrocarbon gas. In this manner it is possible to determine the individual flow rates of the stream(s) flowing through the branch wellbore(s).

The method according to the invention comprises:

a) producing a stream of hydrocarbon gas flowing through a selected one of the branch wellbores to the main wellbore while the other branch wellbores are closed for hydrocarbon gas production;

b) inducing the sound receiver to create a calibration record of the sound wave produced by the sound generating device as a function of the flow rate of the stream of hydrocarbon gas flowing through the selected branch wellbore; and c) repeating steps a) and b) for each branch wellbore. Preferably the method further comprises d) simultaneously producing a plurality of streams of hydrocarbon gas flowing through the respective branch wellbores to the main wellbore;

e) inducing the sound receiver to create a production record of the sound waves produced by the sound generating devices as a result of the streams flowing through the branch wellbores;

f) comparing the production record with the calibration records to determine which branch wellbore is producing hydrocarbon gas.

BRIEF DESCRIPTION OF THE DRAWINGS

The invention will be described further in more detail and by way of example with reference to the accompanying drawings in which FIG. 1 schematically shows a wellbore system in which the system of the invention has been included.

DESCRIPTION OF THE PREFERRED EMBODIMENTS

Figure 1:
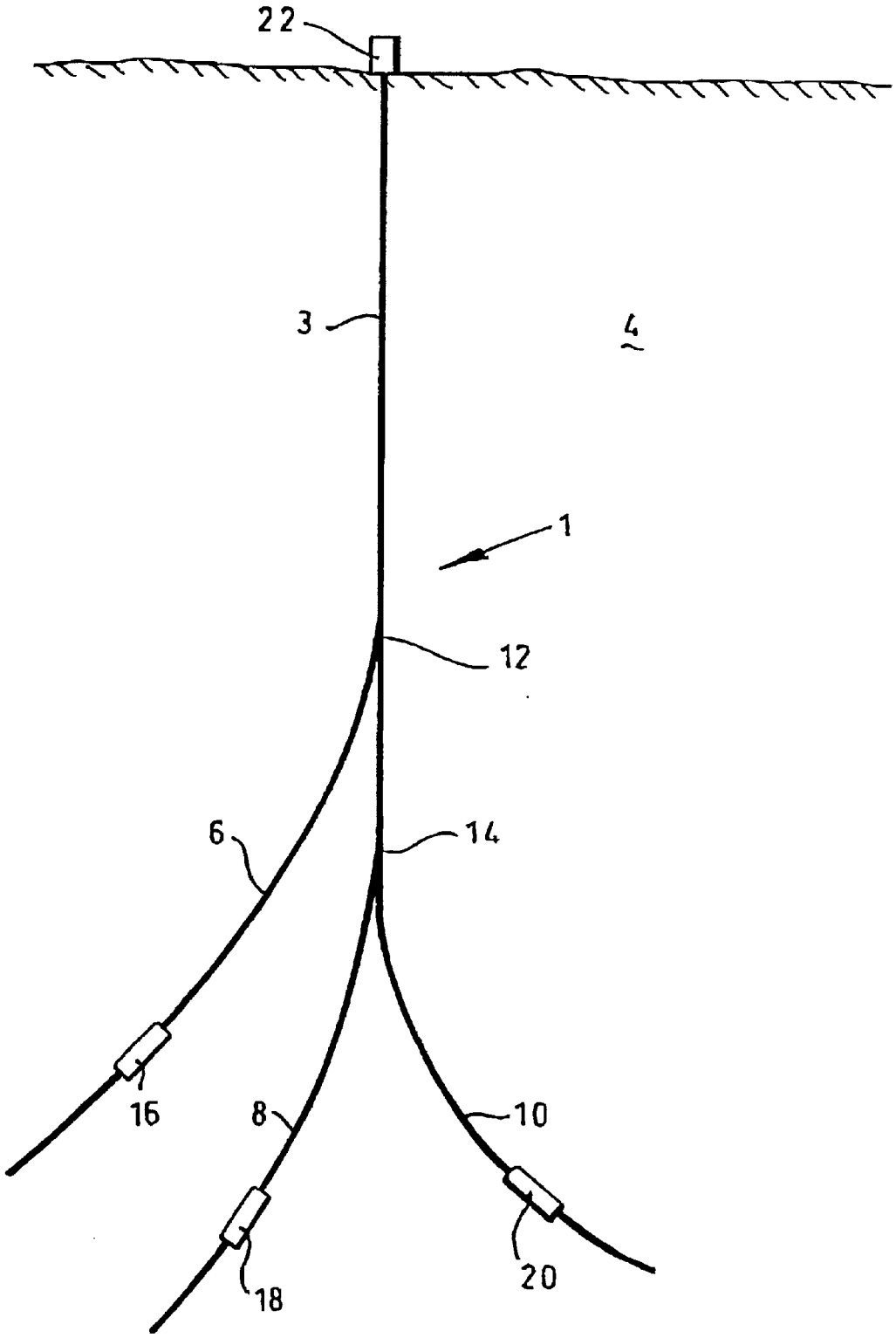

In FIG. 1 is shown a wellbore system 1 including a main wellbore 3 extending from surface into the earth formation 4 and three branch wellbores 6, 8, 10 whereby branch wellbore 6 deviates from main wellbore 3 at wellbore junction 12 and branch wellbores 8, 10 deviate from main wellbore 3 at wellbore junction 14. The wellbores 3, 6, 8, 10 are provided with respective tubular casings (not shown in FIG. 1) which are interconnected at the respective junctions 12, 14. Each branch wellbore 6, 8, 10 is provided with a sound generating device arranged in the respective casing of the branch wellbore, including a first sound generating device 16 arranged in branch wellbore 6, a second sound generating device 18 arranged in wellbore 8, and a third sound generating device 20 arranged in wellbore 10. Each sound generating device 16, 18, 20 is operable to produce a sound wave of frequency characteristic for the device 16, 28, 20 upon flow of the stream of gas along the device, the selected frequencies of the sound waves of the different sound generating devices being mutually different. Furthermore, the amplitude of the sound wave produced by the sound generating device increases with increasing flow rate of the respective stream of gas. A sound receiver 22 including a geophone is arranged at surface near the upper end of the main casing 3, the sound receiver 22 being capable of receiving the sound waves produced by the different sound generating devices 16, 18, 20 and determining the frequencies and amplitudes of the different sound waves.

Figure 3:
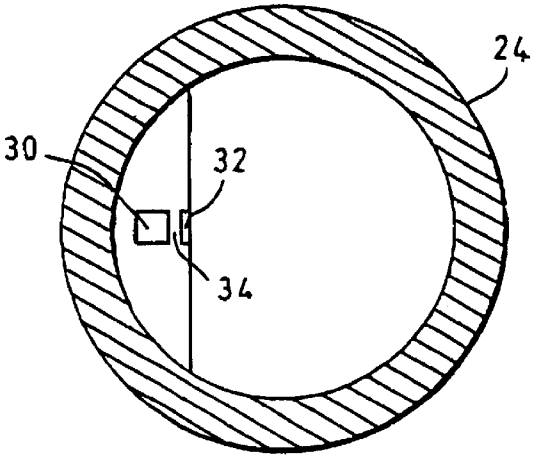
FIG. 3 shows cross-section 3—3 of FIG. 2.
Figure 2:
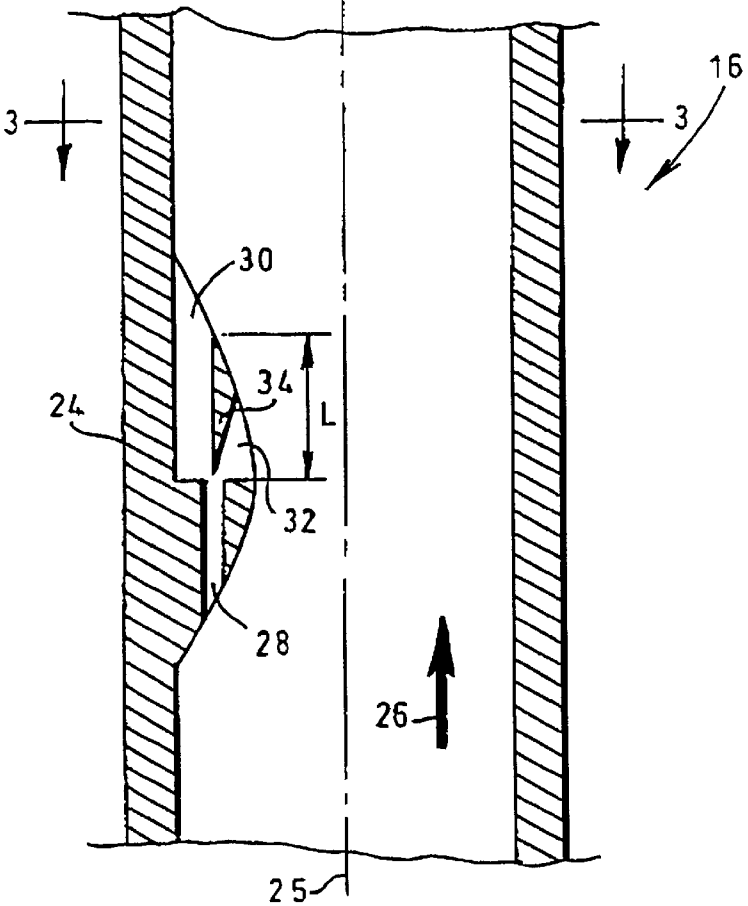
FIG. 2 schematically shows a longitudinal cross-section of a sound generating device applied in the system of FIG. 1.

Referring to FIGS. 2 and 3 there is shown the sound generating device 16 in more detail. The device 16 includes a tubular housing 24 having a longitudinal axis 25. The housing 24 is arranged so that during normal use a stream of hydrocarbon gas produced from the earth formation flows through the housing 24 towards the main wellbore 3 in the direction of arrow 26. The housing 24 is internally provided with a gas inlet 28 and two gas outlets 30, 32 whereby a divider 34 extends between the two gas outlets 30, 32. The divider 34 has a sharp edge located near the downstream end of the gas inlet 28 and has a diverging shape in downstream direction. The distance between the downstream end of the gas inlet 28 and the downstream end of the divider 34 is indicated by L.

The sound generating devices 18, 20 are similar to the sound generating device 16, except that the distance L is mutually different for the three sound generators 16, 18, 20.

During normal operation a calibration procedure is first carried out whereby a stream of hydrocarbon gas is produced through a selected one of the branch well-bores 6, 8, 10 to the main wellbore while the other branch wellbores are closed for hydrocarbon gas production, and whereby the frequency and the amplitude of the sound wave produced by the sound generating device 16, 18, 20 of the selected branch wellbore are recorded by the sound receiver 22 as a function of the flow rate of the stream. Thus, for each sound generating device 16, 18, 20, a calibration record of the characteristic sound frequency and a record of the sound amplitude as a function of flow rate are obtained.

In a next phase hydrocarbon gas is produced from the branch wellbores 6, 8, 10 simultaneously into the main wellbore 3, and from there to a production facility (not shown) at surface. When it is desired to determine the flow rates of the individual streams in the branch wellbores 6, 8, 10, the sound receiver 22 is operated so as to create a sound record. From a comparison between the sound record and the calibration records, the flow rates of the individual streams are then determined.

Should it occur that one of the branch wellbores 6, 8, 10 is producing hydrocarbon gas at an undesirably high flow rate, for example in case of a blow-out, the sound receiver is operated to create a sound record. From a comparison between the sound record and the calibration records it is the determined which branch wellbore 6, 8, 10 is producing at said high rate.

If in an emergency situation the sound receiver 22 is disabled or destroyed, an alternative sound receiver can be arranged at a suitable location on the earth surface and operated in the same manner as described above with reference to sound receiver 22.

What is claimed is:

1. A system for identifying a producing branch wellbore of a multilateral wellbore system including a main wellbore extending from surface into the earth formation and a plurality of branch wellbores, each branch wellbore being provided with a conduit for passage of a stream of hydrocarbon gas from the earth formation to the main wellbore, the system comprising a plurality of sound generating devices, each sound generating device being arranged in a corresponding one of said conduits and being operable to produce a sound wave of selected frequency upon flow of the stream of gas along the sound generating device, the frequencies of the sound waves produced by the different sound generating devices being mutually different, the system further comprising a sound receiver capable of receiving each sound wave of selected frequency.

2. The system of claim 1, wherein the sound generating device is operable to produce a sound wave of amplitude depending on the flow rate of the stream of hydrocarbon gas.

3. The system of claim 2, wherein the amplitude of the sound wave increases with increasing flow rate of the stream of hydrocarbon gas.

4. The system of claim 3, wherein the sound generating device includes a housing provided with an inlet, a divider arranged to divide an inlet stream of gas flowing into the inlet in a first outlet stream flowing into a first outlet of the housing and a second outlet stream flowing into a second outlet of the housing.

5. The system of claim 4, wherein the dividers of the sound generating devices of the different conduits have mutually different lengths.

6. The system of claim 5, wherein the sound receiver comprises at least one geophone arranged at the earth surface.

7. A method of using the wellbore system of claim 6, comprising a) producing a stream of hydrocarbon gas flowing through a selected one of the branch wellbores to the main wellbore while the other branch wellbores are closed for hydrocarbon gas production;

b) inducing the sound receiver to create a calibration record of the sound wave produced by the sound generating device as a function of the flow rate of the stream of hydrocarbon gas flowing through the selected branch wellbore; and c) repeating steps a) and b) for each branch wellbore.

8. The method of claim 7, further comprising d) simultaneously producing a plurality of streams of hydrocarbon gas flowing through the respective branch wellbores to the main wellbore;

e) inducing the sound receiver to create a production record of the sound waves produced by the sound generating devices as a result of the streams flowing through the branch wellbores;

f) comparing the production record with the calibration records to determine which branch wellbore is producing hydrocarbon gas.

* * * * *